US010479537B2

(12) United States Patent
Spatafora et al.

(10) Patent No.: US 10,479,537 B2
(45) Date of Patent: Nov. 19, 2019

(54) APPARATUS FOR PRODUCING PACKAGES OF INFUSION PRODUCTS

(71) Applicant: AZIONARIA COSTRUZIONI MACCHINE AUTOMATICHE A.C.M.A. S.P.A.

(72) Inventors: Mario Spatafora, Granarolo Dell'Emilia-Bologna (IT); Daniele Coi, Bologna (IT); Giacomo Noferini, Castenaso-Bologna (IT); Stefano Nanni, Treviolo-Bergamo (IT)

( * ) Notice: Subject to any disclaimer, the term of this patent is extended or adjusted under 35 U.S.C. 154(b) by 307 days.

(21) Appl. No.: 15/506,714

(22) PCT Filed: Jul. 29, 2015

(86) PCT No.: PCT/EP2015/001658
§ 371 (c)(1),
(2) Date: Feb. 24, 2017

(87) PCT Pub. No.: WO2016/030000
PCT Pub. Date: Mar. 3, 2016

(65) Prior Publication Data

US 2017/0240306 A1 Aug. 24, 2017

(30) Foreign Application Priority Data

Aug. 28, 2014 (IT) ..... BO2014A0469

(51) Int. Cl.
*B65B 29/04* (2006.01)
*B65B 1/30* (2006.01)
(Continued)

(52) U.S. Cl.
CPC ..... *B65B 29/04* (2013.01); *B65B 1/30* (2013.01); *B65B 51/00* (2013.01); *B65B 61/14* (2013.01); *B65D 85/808* (2013.01)

(58) Field of Classification Search
CPC ..... B65B 1/02; B65B 5/045; B65B 5/105; B65B 7/20; B65B 29/04; B65B 29/02; B65B 29/028
(Continued)

(56) References Cited

U.S. PATENT DOCUMENTS 3,143,834 A * 8/1964 Irmscher ..... B65B 29/04 53/397
3,774,369 A * 11/1973 Klar ..... B65B 29/04 53/134.2
(Continued)

FOREIGN PATENT DOCUMENTS

| | | |
|---|---|---|
| DE | 1281927 | 10/1968 |
| GB | 306669 | 11/1931 |
| WO | 0119682 | 3/2001 |

*Primary Examiner* — Hemant Desai
*Assistant Examiner* — Jacob A Smith
(74) *Attorney, Agent, or Firm* — Themis Law

(57) ABSTRACT

An apparatus for producing packages of infusion products, such as a bag filled with a dosed quantity of a product, a tag and a length of thread attached at opposite ends to the bag and to the tag respectively, includes a closing station of the filled bag, a feeding group of the closed bag and of the tag, a sewing station for sewing each length of thread to the tags and to the bags, and an inlet station to a winding group for winding the stitched length of the thread around the bag.

8 Claims, 3 Drawing Sheets

(51) Int. Cl.
*B65B 51/00* (2006.01)
*B65B 61/14* (2006.01)
*B65D 85/808* (2006.01)

(58) Field of Classification Search
USPC ..... 53/414, 128.1, 134.1, 134.2, 139.4, 418
See application file for complete search history.

(56) References Cited

U.S. PATENT DOCUMENTS

| | | | | | |
|---|---|---|---|---|---|
| 5,870,880 | A * | 2/1999 | Romagnoli | B65B 29/04 | 206/5 |
| 5,893,256 | A * | 4/1999 | Ghirlandi | B65B 29/04 | 53/134.2 |
| 6,050,059 | A * | 4/2000 | Rea | B65B 11/54 | 53/413 |
| 6,389,781 | B1 * | 5/2002 | Ghirlandi | B65B 29/04 | 53/134.2 |
| 6,453,639 | B1 * | 9/2002 | Sgubbi | B65B 29/04 | 53/134.2 |
| 6,499,273 | B1 * | 12/2002 | Marzocchi | B65B 29/04 | 493/226 |
| 6,711,876 | B1 * | 3/2004 | Benedetti | B65B 29/04 | 493/375 |
| 8,333,050 | B2 * | 12/2012 | Rea | B65B 29/028 | 53/134.2 |
| 2004/0226263 | A1 * | 11/2004 | Romagnoli | B65B 29/028 | 53/134.2 |
| 2011/0002754 | A1 * | 1/2011 | Spatafora | B65B 61/202 | 412/1 |

* cited by examiner

APPARATUS FOR PRODUCING PACKAGES OF INFUSION PRODUCTS

TECHNICAL FIELD

The present invention relates to an apparatus for producing packages of infusion products, in particular tea and similar products.

KNOWN ART

Apparatuses for packaging infusion products, such as camomile, tea and similar herbs, are known. These products are usually contained in dosed amounts inside specific bags of material permeable to liquids, usually called "filters". In addition to filters, the packaging of these products usually comprises the application of a specific tag, normally made of paper, attached to the filter by means of a suitable length of thread, to allow the handling of the product. Finally, the packaging of infusion products envisages a protective envelope wrapped around the single filter-bag and a packet, for example made of cardboard, in which a plurality of protective envelopes containing the single filter-bags is inserted.

Automatic packaging lines are known for packaging these products, which include a plurality of operative groups suitable for effecting the various packaging operations in a coordinated manner: feeding a dosed quantity of product on a strip made of permeable material, unwound from a respective reel, forming the single filter-bag containing the dosed amount of product, closing the filter-bag, feeding a strip of material for tags, unwound from a further respective reel, separation of the single tags from the above strip, feeding and cutting the joining thread to size, joining each tag and each bag to the respective ends of a cut length of thread, forming single protection envelopes around the bags joined to the tag, packaging in cardboard boxes.

In particular, the packaging comprises the winding phase of the cut length of thread around the bag formed, in a suitable arrangement with respect to the tag.

U.S. Pat. No. 6,389,781, for example, illustrates a bag made of filter-paper around which the relative length of thread is wound during the forming phase of the same bag. More specifically, the length of thread is fixed to both the tag and the bag, in correspondence with opposite ends, by means of heat-sealing, and provided in corresponding zones with a tubular strip suitable for forming a bag. An intermediate length of thread, on the other hand, is zig-zag arranged, and suitably fixed by means of heat-sealing, in correspondence with a zone of the above-mentioned tubular strip, destined for defining the bottom of the bag.

The use of heat joining means, in particular by sealing, or gluing, can cause alterations in the infusion product contained in the filter-paper bag.

The winding of the length of thread around the filter-bags therefore represents a crucial phase in the packaging of infusion products, particularly if the use of heat-joining or gluing means is to be avoided. Effecting a correct winding allows, for example, the tag to be arranged in a clearly visible and centered way, on a side of the filter-paper bag, so that the indications contained on the tag itself can be easily read.

The above winding requires complex mechanical groups, for the handling of the formed bag, whose functioning can negatively influence the overall production rate, due to the complexity of the operations to be effected.

U.S. Pat. No. 3,774,369 A relates to an apparatus for producing packages of infusion products, comprising a bag filled with a dosed quantity of product, a tag and a length of thread attached at opposite ends to the bag and tag respectively, comprising various stations in which the winding of the length of thread sewn around the bag, is effected.

DE 12 81 927 B relates to a winding station equipped with means for effecting the winding of a thread with a tag around a bag.

The known methods and equipment, however, do not allow the production requirements to be satisfied either in terms of velocity or quality of the results obtained.

PRESENTATION OF THE INVENTION

The objective of the present invention is to solve the problems indicated above, by conceiving an apparatus that allows the packaging of infusion products to be optimally effected.

In particular, the objective of the present invention is to conceive an apparatus which allows infusion products to be packaged in bags having a tag and a length of joining thread optimally wound around the bag itself.

Within this objective, a further objective of the present invention is to provide an apparatus for the packaging of infusion products operating under safe and high-speed conditions.

The above objectives are achieved, according to the present invention, by an apparatus for the packaging of infusion products according to the enclosed claims.

In short, the apparatus according to the invention, suitable for obtaining infusion products of the type comprising a bag filled with a dosed quantity of product and suitably closed, a tag and a length of thread attached at opposite ends to the bag and tag, comprises at least a winding group of the length of thread around a bag, defining a rotating carousel in a continuous motion around a rotation axis, suitable for receiving a bag and a tag, attached by means of a length of thread to be suitably wound around the same bag, in correspondence with an inlet station, and releasing the same bag with the length of wound thread and the tag, in correspondence with a release station, downstream of the inlet station, according to the rotation direction of the rotating carousel.

The above carousel comprises at least a winding unit rotated around the above-mentioned rotation axis.

The above winding unit has a first gripping element, a second gripping element and a third gripping element, activated in an appropriate phase relation, for receiving a single bag and a single tag in correspondence with the above inlet station, for effecting the winding around the bag of the relative length of thread, attached at opposite ends to the bag and to the tag, and for withholding the same bag with the wound length of thread and the tag, so as to effect its release in correspondence with the above release station.

The winding group preferably comprises a plurality of winding units, each having the above triple gripping means that can be independently activated, and movable with respect to the carousel itself, in an appropriate phase relation, for receiving articles in the packaging phase, i.e. the bag, the tag and the length of thread being wound, for winding the length of thread around the bag, and for releasing the bag, tag and wound thread.

It should be pointed out that the single winding unit is arranged peripherally with respect to the winding carousel. The same unit comprises a structure rotating according to a winding axis, preferably central, parallel to the rotation axis of the winding group, on which the first gripping element and the second gripping element can be movably positioned.

According to a prerogative of the invention, the first gripping element and the second gripping element can be moved according to a relative motion, in an activation direction, preferably parallel to the rotation axis of the rotating carousel.

In practice, the first and second gripping element can be moved relatively according to the above activation direction, to allow the passage from a first condition in which the bag is gripped and withheld by one of the two elements, and the other element is distanced in the above direction, to a second condition in which the bag is gripped and withheld by the other gripping element, and the previous element is distanced, through an intermediate interaction configuration, in correspondence with which the first gripping element and the second gripping element are suitable for both interacting in correspondence with respective distinct portions of articles in the packaging phase, therefore basically the bag and the tag, so as to allow the gripping passage from one element to the other.

In short, in the first condition and in the second condition, the first gripping element and the second gripping element are reciprocally distanced from each other, so that there is no possibility of interference.

Basically, the first gripping element grips the bag in the winding phase of the length of thread, whereas the second gripping element receives and grips the bag in correspondence with the inlet station and before the release station, with the tag positioned and the thread wound, in this case by the first gripping element. The transfer of the grip is effected in correspondence with the above intermediate interaction configuration, basically in reciprocal approach, between the above-mentioned first gripping element and second gripping element.

The third gripping element cooperates with the winding of the length of thread around the bag. The third gripping element is, in particular, destined for gripping the tag, guiding the winding of the length of thread around the bag and effecting the positioning of the tag on the bag at the end of the winding of the length of thread.

According to an aspect of the invention, the third gripping element is therefore carried in rotation by the rotating carousel and can also rotate according to a first axis and a second axis slanting with respect to each other, preferably orthogonal. In short, the third gripping element oscillates around the first axis and second axis, in an appropriate phase relation, to suitably guide the orientation of the tag with respect to the bag, at the same time effecting the winding of the length of thread.

According to an aspect of the invention, the third gripping element is carried at the end of an articulated arm. The articulated arm comprises a first portion pivoted to a base integral with the rotating carousel according to the above first axis and a second portion carrying the third gripping element, articulated to the first portion around the above-mentioned second axis.

BRIEF DESCRIPTION OF THE DRAWINGS

The characteristics of the invention will appear more evident from the detailed description of a preferred embodiment of the apparatus for packaging infusion products according to the invention, indicatively illustrated in the enclosed drawings, in which.

EMBODIMENTS OF THE INVENTION

Figure 1:
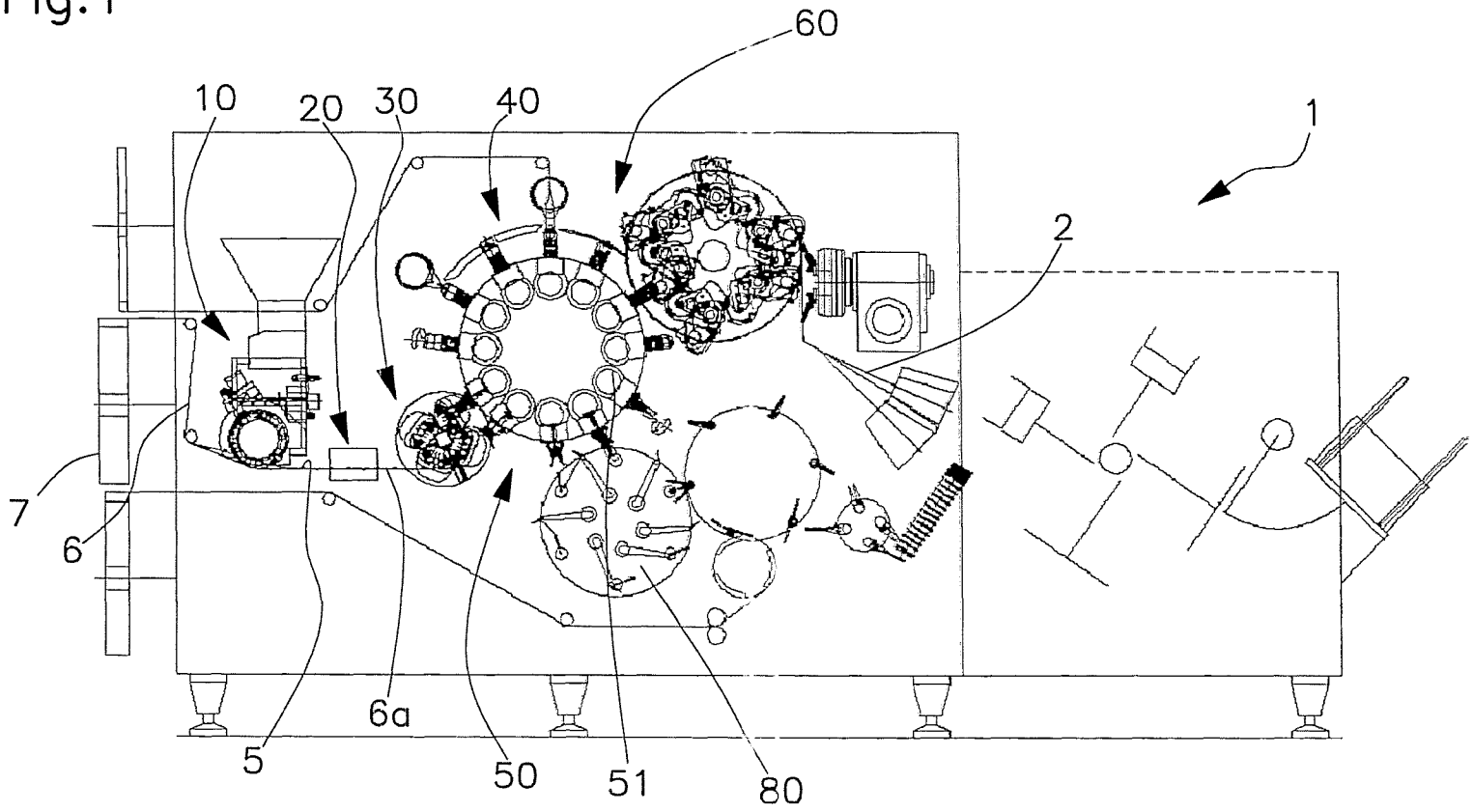
FIG. 1 shows a schematic front view of the apparatus according to the invention.

With particular reference to the above figures, the apparatus for producing packages of infusion products, such as, for example, tea, camomile, herbal teas or other infusions, is indicated as a whole with 1 (see FIG. 1).

In particular, the apparatus 1 operates on a length of thread 2, a bag 3 and a tag 4, for winding the same length of thread 2, attached at opposite ends respectively to both the bag 3 and the tag 4, around the same bag 3.

The bag 3 is suitably filled with a dosed quantity of product.

Figure 4:
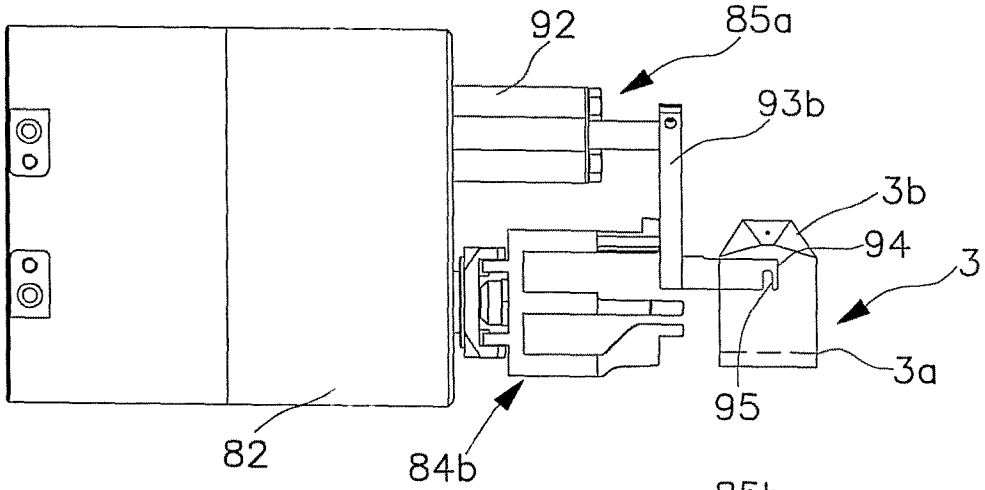
FIGS. 3 and 4 respectively show a side view of a detail of the winding group illustrated in FIG. 2, in different operative configurations.
Figure 3:
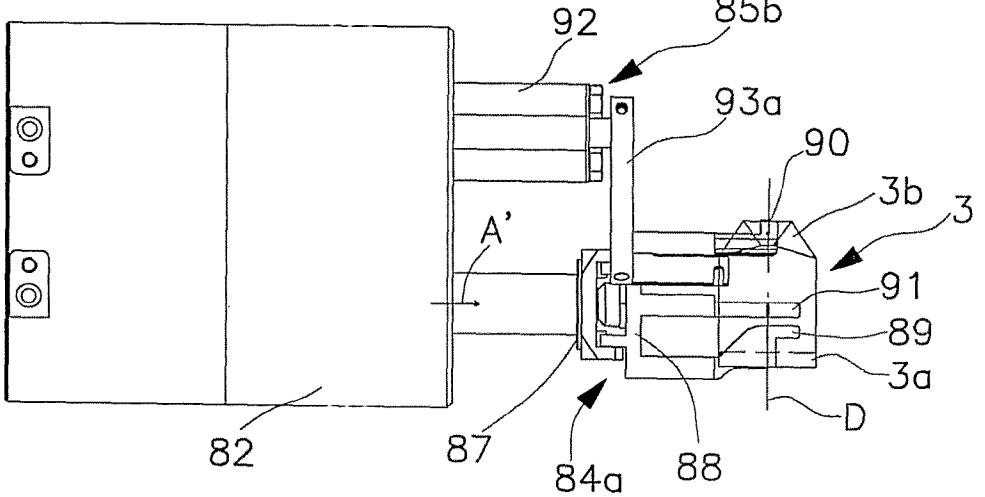

More specifically, the bag 3 can have, for example, as in the case illustrated, a so-called "two-lobed" conformation. In practice, each bag 3 is formed by the folding of a pair of respective containment portions, in each of which a single dose 5 of product is inserted. The bag 3, usually made of filter paper, permeable to water or other infusion liquid, has a base 3*a*, for example, bellow-folded, and a closing end 3*b* carrying one or more folded flaps to ensure the sealing of the product contained therein (see FIGS. 3 and 4).

The tag 4 is preferably made of paper or similar material, suitable for containing printed identifying information of the product. The length of thread 2, connecting the bag 3 and the tag 4, serves for allowing the product to be handled in the infusion phase, to avoid direct contact with the infusion liquid, which generally has a high temperature.

The apparatus 1 therefore comprises a dosing group 10 of the infusion product, suitable for dosing single quantities or doses 5 of product for positioning them on a strip 6 of suitable material, preferably filter paper, unwound from a respective reel 7 schematized, for the sake of simplicity, in FIG. 1. In practice, the single doses 5 are neatly arranged in succession on the strip 6, preferably fed on a substantially horizontal run.

Downstream of the dosing group 10, the apparatus 1 can comprise a longitudinal sealing group 20, suitable for folding the doses 5 and reciprocally closing the longitudinal edges of the strip 6 being unwound, so as to form a tube 6*a* containing in its interior, the doses 5 prepared by the dosing group 10 (see, in particular, FIG. 1).

Downstream of the sealing group 20, the apparatus 1 can comprise a forming group 30 of the single bags 3 starting from the tube 6*a* previously sealed longitudinally by the sealing group 20.

The apparatus 1 can also comprise a closing station 40 of the closing end 3*b* of the bag 3, opposite the base 3*a*.

The apparatus 1 also comprises a transfer carousel 50 of the bags 3, which transfers the same bags 3 between the closing station 40, a joining station, for example a sewing station 60, for sewing the single lengths of thread 2 to the tags 4 and bags 3, and an inlet station 70 to the winding group 80, for winding the sewn length of thread 2, around the bag 3. During the transfer, the transfer group 50 is suitable for also receiving the tags 4 from specific feeding means.

The transfer carousel 50 preferably comprises a plurality of transfer units 51 peripherally carried in rotation.

In correspondence with the above inlet station 70, each transfer unit 51 transfers a bag 3 and a tag 4, both attached to the length of thread 2, to the winding group 80. In correspondence with the above inlet station 70, the bag 3 and the tag 4 are arranged according to an oriented configuration, suitable for the subsequent handling on the part of the winding group 80, which effects their release, at the end of the winding phase, in correspondence with a release station 100 for the subsequent packaging phases, for example in boxes.

More specifically, the winding group 80 defines a carousel rotating according to a rotation axis A preferably substantially horizontal, in a continuous motion. In particular, in correspondence with the inlet station 70, the median plane and longitudinal axis of the bag 3 are preferably substantially radially oriented with respect to the above carousel 80.

The winding group 80 preferably carries peripherally, a plurality of winding units 81 suitable for appropriately moving the above packaging articles received from the transfer units 51, therefore the bag 3, the tag 4 and the length of thread 2 attached to them, for neatly winding the length of thread 2 itself around the bag 3.

Figure 2:
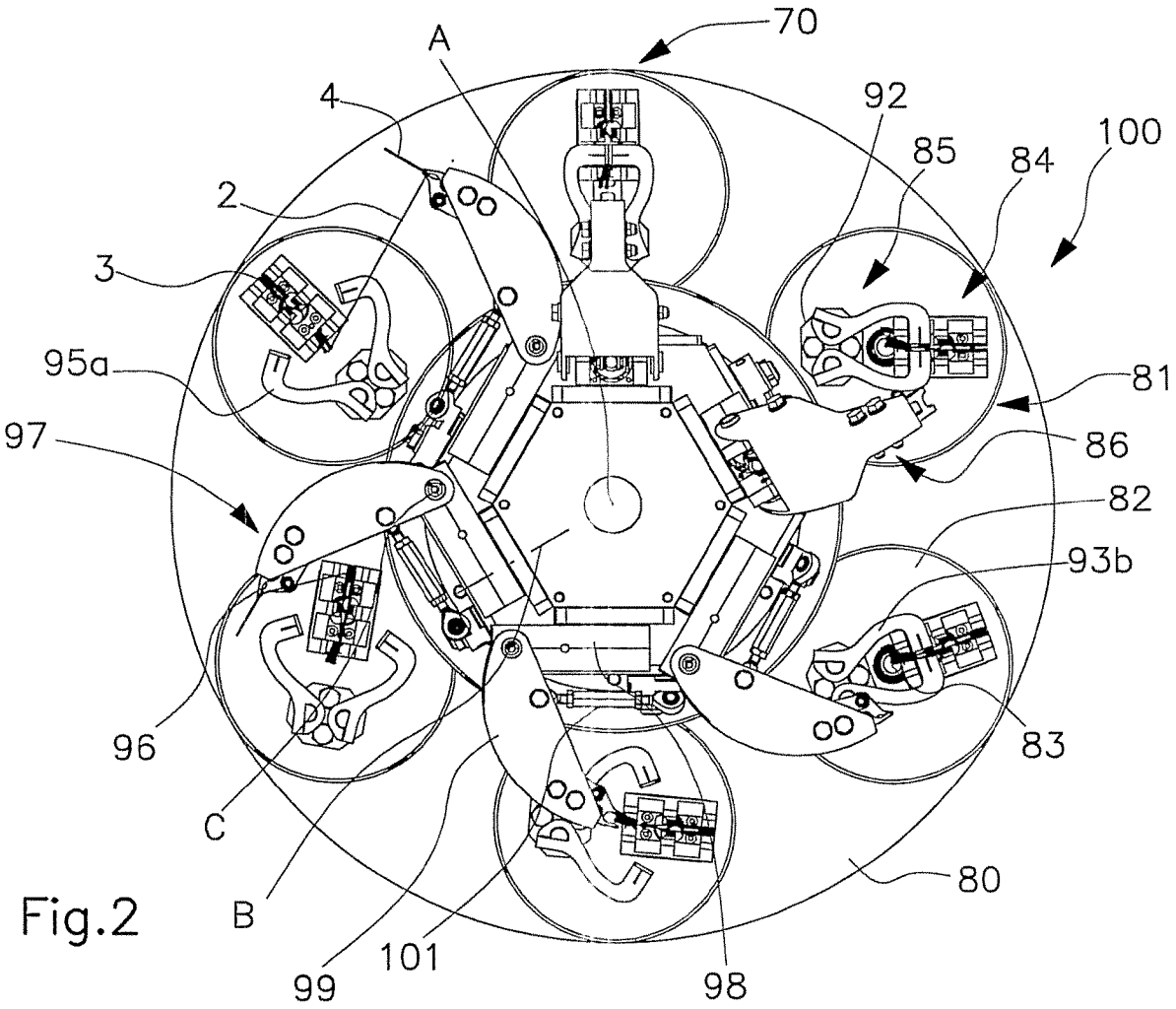
FIG. 2 shows a front view of the winding group, suitable for being used in the same apparatus.

In the case illustrated in FIG. 2, the winding group 80 comprises six winding units 81, distributed around the rotation axis A of the above-mentioned winding carousel. A different number and arrangement of winding units 81 can obviously be envisaged.

Each winding unit 81 comprises, in addition to the other elements described hereunder, a structure 82, rotatable according to a winding axis 83 preferably central, parallel to the rotation axis A of the rotating carousel 80. A first gripping element 84 and a second gripping element 85, activated in an appropriate phase relation, along an activation direction A', preferably parallel to the winding axis 83, are movably positioned on the structure 82, preferably defining a rotating platform.

The winding unit 81 also comprises a third gripping element 86, integral with the carousel 80 and associated with the respective structure 82, described in detail hereunder, for handling the tag 4, already attached by means of the length of thread 2 to the bag 3, which, on the other hand, is gripped, in succession, by the first gripping element 84 and second gripping element 85, in an appropriate phase relation (see FIG. 2).

The first gripping element 84 and the second gripping element 85 can be alternatingly moved according to a relative motion along the above activation direction A', alternating between a first condition, in correspondence with which only one gripping element 84, withholds the bag 3, and a second condition, in correspondence with which the other gripping element 84, withholds the bag 3, through an intermediate interaction configuration, reciprocally close to each other, in correspondence with which the first gripping element 84 and the second gripping element 85 are both suitable for interacting with respective portions of bag 3.

This relative motion basically serves for transferring the grip of the bag 3, and possibly the positioned tag 4, from the first gripping element 84 to the second gripping element 85 and viceversa, and also, as described in detail hereunder, for allowing the above-mentioned packaging articles to be received and released from the stations upstream and to the stations downstream of the winding group 80.

The first gripping element 84 defines, for example, a first pincer element carried by a turret 87 movable in the activation direction A'. The first pincer element 84 comprises a pair of arms or crosspieces 88, alternatingly activated between an approach position, for gripping the bag 3, and an opening position, suitable for releasing or receiving the bag 3, in correspondence with the release station 100 or inlet station 70, respectively.

The pair of crosspieces 88 carries at least a respective first pair of beaks 89, conformed for withholding the bag 3, in correspondence with the base 3*a*. The pair of crosspieces 88 preferably also carries a second pair of beaks 90, conformed for withholding the closing end 3*b* of the bag 3. The first pair of beaks 89 and the second pair of beaks 90 are preferably conformed so as to adequately cover, in an active gripping configuration, the respective opposing edges of the bag 3 so as to be interposed, between the length of thread 2 and the same bag 3, during the winding phase, to protect the bag 3 from any tensioning action. The crosspieces 88 preferably also carry a third pair of beaks 91, for gripping a respective intermediate portion of the bag 3.

The first pair of beaks 89 and the third pair of beaks 91 are preferably aligned on the same plane which substantially corresponds to the median plane of the bag 3.

The second pair of beaks 90, on the other hand, is preferably slightly tilted with respect to said median plane, so as to correspondingly tilt the bag 3 withheld in correspondence with the closing end 3*b*. Said inclination of the bag 3 is advantageous, in the winding phase of the length of thread 2, as it provides for a subsequent stretching of the released bag 3 and consequently a corresponding tensioning of the length of thread 2 around the bag 3. The length of thread 2 is therefore tightly arranged around the bag 3, and the packaging has the desired appearance. More specifically, said stretching can be effected when the bag 3 with the wound length of thread 2 is transferred from the first gripping element 84 to the second gripping element 85, as described in detail hereunder.

It should be pointed out that the pairs of beaks 89, 90, 91 are substantially aligned, with respect to each side of the bag 3, along an ideal winding line D, on which the length of thread 2 is to be wound. Said winding line D preferably corresponds to the line of a median transversal plane, in the longitudinal direction of the bag 3.

The first gripping element 84 can therefore be moved on the structure 82 according to an activation direction A', substantially parallel to the rotation axis A of the carousel 80 or the winding axis 83, alternating between an active extracted position 84*a*, in correspondence with which the beaks 89, 90, 91 reach the level of the above winding line D of the bag 3, and a withdrawn rest position 84*b*, which does not interfere with the second gripping element 85, in correspondence with which the beaks 89, 90, 91 are below the above receiving and winding level.

The beaks 89, 90, 91, carried by the crosspieces 88 through respective stems, are preferably oriented along the same activation direction A'.

The second gripping element 85 preferably defines a second pincer element carried by a respective second turret 92, adjacent to the first turret 82, on the platform 80. The second turret 92 therefore carries a pair of arms 93 alternatingly movable between an open position 93*a* and a closed position 93*b*, for the gripping of the bag 3.

The arms 93 of the second pincer element 85 are preferably reciprocally hinged, so that they can be opened, from the above closed position 93*b*, to the branched open position 93*a*.

More specifically, in correspondence with said open position 93*a*, the arms 93 of the second gripping element 85 do not interfere with the beaks 89, 90, 91, of the first gripping element 84, the two groups are consequently non-interfering, in the above distanced position. When the arms 93 are in an open position 93*a*, the first element 84 can withhold the bag 3, with the beaks 89, 90, 91. In the same position, the structure 82 can rotate around its axis, to effect the winding of the length of thread 2, controlled by the third gripping element 86, which withholds the tag 4, as described in more detail hereunder.

The arms 93 preferably develop in a substantially orthogonal direction with respect to the above activation direction A', along which, on the other hand, the beaks 89, 90, 91 carried by the first turret 87, can move.

More specifically, the pair of arms 93 also carries, at the end, respective gripping beaks 94, suitable for intercepting a portion of the bag 3, in a closed position 93*b*, interposed between the second beaks 90 and third beaks 91, without interfering with the respective action spaces.

In this way, the second gripping element 85 receives the bag 3 from the transfer unit 51 in correspondence with the inlet station 70.

The same second gripping element 85 subsequently receives the bag 3 back from the first gripping element 84, when the length of thread 2 is wound along the winding line D, around the bag 3, and the tag 4 rests on a side of the same bag 3, at the closing end 3*b*, to transfer it to the subsequent packaging stations in correspondence with the release station 100. In this circumstance, the tag 4 extends substantially from the upper edge of the bag 3, possibly being shaped so as to follow the profile of the same upper edge, as far as an intermediate portion of the bag 3, on which the gripping beaks 94 of the second gripping element 85 are suitable for interacting. This element is therefore suitable for withholding the bag 3, the tag 4 and a portion of the length of thread 2 already wound.

It should be noted that the gripping beaks 94 preferably define a notch 95, oriented, when in use, towards the bottom 3*a* of the bag 3, suitable for allowing the wedge-insertion of the wound length of thread 2 into a corresponding notch preferably situated on the edge of the tag 4. The wedge-insertion is obtained as a result of the grip effected by the beaks 94, that are withholding the thread 2 on one side of the notch, and, contemporaneously, the release on the part of the first pair of beaks 89 and, if envisaged, by the third pair of beaks 91 of the first gripping element 84, which, on the other side of the same notch, lift the same thread 2 from the side of the bag 3, bringing it and wedge-inserting it specifically in the notch present on the edge of the tag 4. The insertion of the thread 2 in the notch of the tag 4 guarantees a more stable packaging.

The second gripping element 85 can therefore also be moved in the activation direction A', between an extracted exchange operative configuration 85*a*, in correspondence with which the gripping beaks 94 carry the bag 3 in a closed condition 93*b* of the arms 93, to a level corresponding to the above-mentioned receiving and winding level, for introducing and releasing the bag 3 in the corresponding stations 70, 100, and for the gripping passage, with the first gripping element 84, arranged in turn in an active extracted configuration, 84*a*, and a withdrawn rest configuration 85*b*, in correspondence with which the gripping beaks 94 are distanced from the same receiving and winding level, arranged in an open condition 93*a*, to allow the winding of the thread 2 around the bag 3 withheld by the first gripping element 84.

The third gripping element 86 cooperates with the winding of the length of thread 2 around the bag 3 and positioning of the tag 4 on the bag 3 itself, withholding the tag 4, so as to guide the winding of the length of thread 2 around the bag 3.

The third gripping element 86 comprises a gripping head 96 situated at the end of an articulated arm 97.

More specifically, the gripping head 96 defines openable pincers, suitable for gripping a tag 4.

The articulated arm 97 is assembled on the carousel 80, rotatable according to a first slanting oscillation axis B, preferably orthogonal with respect to the rotation axis A of the same carousel. The articulated arm is produced by means of a first component 98 rotatingly assembled on the carousel 80, and a second component 99 articulated to the first component in correspondence with an articulation axis C, in turn slanting with respect to the oscillation axis B.

In short, the third gripping element 86 oscillates around the oscillation axis B and the articulation axis C, in an appropriate phase relation, to suitably guide the orientation of the tag 4 and, consequently, length of thread 2, with respect to the bag 3, at the same time, allowing the winding of the length of thread 2 around the bag 3 brought into relative rotation by the structure 82.

Thanks to the oscillation movement around the oscillation axis B, activated by respective activation means, the gripping head 96 can in fact receive a tag 4, in correspondence with the inlet station 70, according to an ingoing orientation, and subsequently position it, whereas the carousel 80 rotates around its own rotation axis A, according to a winding orientation, specifically rotated around the above oscillation axis B.

In particular, according to the ingoing orientation, the tag 4 can be arranged on a plane orthogonal to the median plane of the bag 3, in the same inlet station 70, therefore on a plane orthogonal to the rotation axis of the carousel 80 (see FIG. 2).

According to the winding orientation, on the other hand, the bag 4 can be rotated by the articulated arm 97 having an angular amplitude of substantially 90°, for example, to then rest on a side of the bag 3, at the end of the winding.

The articulated arm 97 is activated by activation means, by the interpositioning of a further component 101, for example a tie-rod connected to the second component 99, to effect a progressive approaching movement of the gripping head 96 to the respective structure 82 which is withholding the bag 3, so as to progressively feed the length of thread 2 in the winding phase around the bag 3 itself. The above approaching movement is enabled by the corresponding folding of the first component 98 and second component 99 around the articulation axis C.

At the end of this approaching run, the gripping head 96 can rest the tag 4 on a side of the bag 3, in correspondence with the end 3*a*, subsequently releasing it, as soon as the second gripping element 85 has been activated, to withhold the bag 3 and the tag 4.

The functioning of the apparatus for the packaging of infusion products can be understood from the above description.

A formed bag 3, a tag 4 and a length of thread 2 attached at opposite ends to the bag 3 and to the tag 4, are fed to the inlet station 70 of the winding group 80 by a transfer unit 51. The bag 3 is preferably arranged according to an ingoing orientation, having the respective median plane positioned radially with respect to the rotation axis A of the winding group 80, whereas the tag 4 is preferably arranged according to a respective ingoing orientation, orthogonal to the bag 3.

The second gripping element 85 of the winding unit 81, which is positioned in said inlet station 70, is then activated to cooperate in exchange with the transfer unit 51, so as to grip the bag 3 at the inlet. For this purpose, the second gripping element 85 is arranged in the extracted exchange operative configuration 85*a*, to receive the bag 3 in correspondence with the receiving level, in which the transfer unit 51 operates.

In the same exchange phase, in correspondence with the inlet station 70, the third gripping element 86 is also arranged in an active position, so as to grip the tag 4, already attached to the bag 3 by the length of thread 2, by means of the same transfer unit 51, in the respective ingoing orientation.

The first gripping element 84, in the respective active position 84*a*, is then activated, in correspondence with which the interaction, i.e. the exchange, is enabled between the two gripping elements 85, 84, to receive the bag 3 from the second gripping element 85, in the meantime or subsequently brought into the withdrawn rest position 85*b*.

The bag 3 is then rotated by the structure 82 of the winding unit 81, rotating integrally with the winding group 80, around the rotation axis A and around its own winding axis 83.

Furthermore, the articulated arm 97 is rotated around the oscillation axis B to bring the tag 4 onto a plane parallel to the rotation axis 83 of the winding unit 81, to allow the winding of the length of thread 2.

The winding is subsequently completed by the combination of the rotation movement of the unit 81 around the winding axis 83, with the approaching movement of the gripping head 96 to the bag 3, for feeding the length of thread 2.

It should be pointed out that following said winding movement, the length of thread 2 is progressively wound around the bag 3, outside and resting on the beaks 89, 90, 91 of the first gripping element 84.

The winding process of the length of thread 2 is therefore advantageously effected without direct contact with the sides, front and rear, of the bag 3. There is direct contact, on the contrary, between the length of thread 2 and the beaks 89, 90, 91, preventing any tensioning or stress due to the winding from being transmitted to the bag 3. This, in particular, is enabled by the fact that the beaks 89, 90, 91 of the first gripping element 84 arranged in an active position 84*a*, engage the bag 3 in correspondence with the winding line D, on which the thread 2 is arranged, once wound. The winding line D, as already indicated, preferably corresponds with the median axis of the bag 3 (see FIG. 3).

The outermost beaks 89 and 91, moreover, are preferably shaped so as to adequately cover the portions of the base 3*a* and closing end 3*b*, respectively, of the bag 3, involved in the winding of the length of thread 2, so as act as an effective abutment, and also as a protection against the above-mentioned stress, as the bag 3, in itself flexible, cannot oppose any substantial resistance.

At the end of the winding, when, for example, the length of thread 2 has been wound once around the bag 3, the gripping head 96 rests the tag 4 on a side of the bag 3.

At this point, the second gripping element 85 is reactivated, starting from the withdrawn rest position 85*b* and with the arms in an open configuration 93*a*, to take over the bag 3 with the tag 4.

The arms 93 are activated in a closed position 93*b*, without interfering with the beaks 89, 90, 91, of the first gripping element 84, to withhold the bag 3 and tag 4 in an intermediate portion between the closing end 3*b* and the base 3*a*. The subsequent closing of the pincer element 85, together with the opening of the crosspieces 88, therefore produces the engagement and wedge-insertion of the thread 2 inside the respective notch arranged peripherally with respect to the tag 4, through the notch of the gripping beak 94. The disengagement of the first gripping element 84 also causes the stretching of the bag 3, previously subjected to inflexion in correspondence with the second pair of beaks 90, thus causing the correct tensioning of the length of thread 2 wound around the bag 3 (see FIG. 4).

The gripping head 96 then releases the tag 4 and the first gripping element 84 is brought into the withdrawn rest configuration 84*b*.

The second gripping element 85 is brought to the extracted exchange operative position 85*a*, to transfer the wound bag 3 to the subsequent operative phases, in correspondence with the release station 100.

The packaging apparatus, as also the winding group described for illustrative purposes, therefore achieve the objectives specified above, in particular, for effecting the continuous winding of the length of thread 2 to the bag 3, together with the correct and firm positioning of the tag 4 on a side of the bag 3 itself.

The packaging apparatus, as also the winding group described for illustrative purposes, can undergo numerous modifications and variants according to the various requirements.

In the practical embodiment of the invention, the materials used, as also the form and dimensions, can vary according to requirements.

When the technical features in each claim are followed by reference signs, said reference signs have been included for the sole purpose of providing a better understanding of the claims and consequently they have no limiting value with respect to the purpose of each element identified for exemplifying purposes by said reference signs.

The invention claimed is:

1. An apparatus for producing packages of infusion products, said packages comprising a bag filled with a dosed quantity of an infusion product, a tag, and a length of thread attached to opposite ends to said bag and respectively said tag, said apparatus comprising:

a winding group configured to wind said length of thread around said bag after said bag has been filled, said winding group comprising, a rotating carousel rotatable around a rotation axis, and at least one winding unit positioned on said rotating carousel and brought into rotation by said rotating carousel between an inlet station and a release station, said bag being received at said inlet station with said tag attached thereto by said length of thread and having said length of thread wound thereabout in said at least one winding unit before release at said release station, wherein said at least one winding unit comprises, a rotatable structure, and a first gripping element and a second gripping element, which are configured to be activated independently and to withhold said bag either individually or jointly, a third gripping element carried by said carousel and associated to said rotating structure, said third gripping element being configured to withhold said tag, wherein said carousel rotates in a continuous motion, wherein said winding unit is further configured to move said first and said second gripping elements outwardly and inwardly in relation to said structure and to cause said second gripping element to grip and withhold said bag individually while said first gripping element is distanced from said bag, or to cause said second and said first gripping elements to jointly grip and withhold said bag, thereby enabling a gripping passage from the second gripping element to the first gripping element or vice versa, or to cause said first gripping element to grip and withhold said bag individually while said second gripping element is distanced from said bag.

2. The apparatus according to claim 1, wherein said second gripping element comprises a pair of openable arms, which are movable between a closed position and an open position and carry gripping beaks adapted to engage a portion of said bag in said closed position (93*b*).

3. The apparatus according to claim 2, wherein at least one of said gripping beaks comprises a first notch oriented towards a base of said bag, thereby allowing an insertion of said length of thread in a second notch formed in said tag.

4. The apparatus according to claim 1, wherein said first gripping element comprises a pair of openable crosspieces carrying a first pair of beaks adapted to withhold a base of said bag, and a second pair of beaks adapted to withhold said bag at a closing end, said first and said second pairs of beaks becoming interposed between said length of thread and said bag during a winding of said thread around said bag.

5. The apparatus according to claim 1, wherein said third gripping element comprises a gripping head disposed at an end of an articulated arm, said articulated arm being assembled on said rotating carousel.

6. The apparatus according to claim 5, wherein said gripping head comprises openable pincers.

7. The apparatus according to claim 5, wherein said articulated arm is assembled on said rotating carousel according to a oscillation axis to slant in relation to said rotation axis of said carousel, so as to modify an orientation of said tag received in said inlet station.

8. The apparatus according to claim 7, wherein said articulated arm comprises a first component rotatably assembled on said carousel and a second component articulated to said first component with an articulation axis slanting with in relation to said oscillation axis, so as to guide a winding of said length of thread around said bag withheld by said first gripping element.

* * * * *